United States Patent [19]

Wittkopf et al.

[11] 4,361,089

[45] Nov. 30, 1982

[54] MULTI-COLOR ROTARY PRESS

[75] Inventors: Eugene W. Wittkopf, Suamico; Dale D. Leanna, Little Suamico, both of Wis.

[73] Assignee: Magna-Graphics Corporation, Oconto Falls, Wis.

[21] Appl. No.: 198,297

[22] Filed: Oct. 20, 1980

[51] Int. Cl.[3] ..... B41F 5/16; B41F 13/40; B41F 31/06; B41F 31/36

[52] U.S. Cl. ..... 101/182; 101/207; 101/210; 101/247; 101/352; 101/366

[58] Field of Search ..... 101/247, 216–219, 101/220, 352, 351, 178, 179, 180, 181, 182, 184, 185, 138, 139, 140, 143, 144, 145, 206, 207, 208, 209, 210, 366

[56] References Cited

U.S. PATENT DOCUMENTS

| | | | |
|---|---|---|---|
| 2,764,086 | 9/1956 | Huebner | 101/179 |
| 3,792,658 | 2/1974 | Shore et al. | 101/352 X |
| 4,141,293 | 2/1979 | Corse | 101/181 |
| 4,165,688 | 8/1979 | Leanna et al. | 101/207 |

*Primary Examiner*—J. Reed Fisher
*Attorney, Agent, or Firm*—James E. Nilles

[57] ABSTRACT

In a rotary press wherein ink nozzles apply different colored inks to different sections of an inking cylinder along the length thereof, and wherein excess inks run off of the inking cylinder into a compartmented inking pan, an anilox cylinder, by which ink is transferred from the inking cylinder to a plate cylinder, rotates on an axis that is fixed relative to a stationary frame for the press. The ink pan and its dividers are also stationarily secured to said frame. The plate cylinder and an impression cylinder that cooperates with it for imprinting a web are rotatably supported on sliders that carry those cylinders for bodily motion towards and from the anilox cylinder and one another. For easy change of ink color on inking cylinder sections, each compartment of the ink pan has plural readily closeable drain outlets that respectively lead to different ink reservoirs, there is an ink pump for each reservoir, and an elongated ink feed manifold for each pump has readily closeable outlets that provide for disconnectable communication with any ink nozzle.

3 Claims, 7 Drawing Figures

MULTI-COLOR ROTARY PRESS

FIELD OF THE INVENTION

This invention relates to flexographic multi-color printing presses such as are used for imprinting colored designs on paper towel stock and the like and whereby different colored inks are applied in different zones across the width of a relatively wide web to be imprinted; and the invention is more particularly concerned with a flexographic press having an elongated inking cylinder that is divided along its length into discrete sections, to each of which a different colored ink is applied, and fountain means for applying inks to that cylinder and for recirculating excess inks that drop off of it, said fountain means comprising ink dams or dividers that prevent mixing of the differently colored inks.

BACKGROUND OF THE INVENTION

A multi color flexographic press of the general type to which this invention relates is disclosed in U.S. Pat. No. 4,165,688, to D. R. Leanna et al. Such a press is typically employed for imprinting paper towel stock as it comes off of a parent roll in the form of a very wide web. Unlike most prior presses, wherein ink of only one color was applied to any one inking cylinder, the press of that patent has a single elongated inking cylinder which is divided along its length into several discrete sections, and a different colored ink can be applied to each such section so that a web passing through the press is imprinted with several lengthwise extending bands, each band being of a different color and having a width that substantially corresponds to the length of a consumer roll of paper towels or to a multiple of that length. When such an imprinted web is slit and rewound into consumer rolls, the resultant product can constitute rolls in the complete assortment of colors to be offered, with a like number of rolls of each color, all produced at the same time. As compared with prior printing apparatus, on which product of only one color could be run at any given time, such split-color printing greatly simplified the storage of different colored products and the selection, packaging and shipping of various colors and color assortments. Because of the efficiencies and economies that it affords, the split color press of the Leanna et al patent has had marked commercial success.

However, from time to time during the several years that such presses have been in commercial use, they have presented certain annoying problems that have somewhat diminished the advantages that they offer. In retrospect, the cause of those problems and the solution to them may appear to be rather simple, but the fact that it took several years to find the solution is testimony to the unobviousness of it. It is possible that the solution to those problems was hard to find because it required a breaking away from certain features of flexographic press arrangement that had been conventional for such a long time, and had been so consistently used as to have been accepted by those skilled in the art as necessary and inevitable.

In a flexographic press, the imprinting of the web is done by a flexible plate carried by a plate cylinder, and ink is transferred from the inking cylinder to the plate cylinder by means of an anilox or transfer cylinder that rotates between them and is in contact with both of them in an operative or press-closed condition. The web, as it moves in contact with the plate cylinder, is backed up by an impression cylinder. When the press is in open, non-printing condition, the anilox cylinder must be spaced from the plate cylinder; but the inking cylinder and the anilox cylinder, although preferably separable, should normally continue to rotate in contact with one another to prevent ink from drying on the anilox cylinder. There should also be provision for a spacing apart of the plate cylinder and the impression cylinder in the press-open condition, to permit web to be threaded between them and to facilitate changing of plates.

Heretofore it has been conventional to mount the impression cylinder for rotation at a fixed location and to arrange the other three cylinders for press-closing and press-opening motion toward and from the impression cylinder and one another. The split-color press of the Leanna et al patent followed this conventional arrangement. A first slidable support carried the plate cylinder for movement towards and from the impression cylinder and also carried a second slidable support on which the anilox cylinder was carried for movement toward and from the plate cylinder. Arms swingable on the second support carried the inking cylinder for movement toward and from the anilox cylinder. The second slidable support also carried the fountain structure that served for applying ink to the inking cylinder.

In the press of the Leanna et al patent, the inking cylinder has circumferential grooves around it at intervals along its length, to define its several sections upon which different colored inks can be applied. For each of the several sections of the inking cylinder there is an ink nozzle from which ink is applied to the section at a rate somewhat faster than it is needed. The excess ink drains off of the inking cylinder into an ink pan that underlies the inking cylinder and the anilox cylinder, for recirculation back to the nozzle. To prevent mixing of different colored inks, the ink pan is divided into separate ink compartments, one for each section of the inking cylinder, by means of ink dams or dividers. Each ink dam extends edgewise in line with one of the grooves in the inking cylinder and serves to prevent flow of ink between the sections at the opposite sides of that groove, in addition to sealing each compartment against seepage of ink into an adjoining compartment.

For preventing flow of ink between sections of the inking cylinder, each ink dam has a hole therein through which the inking cylinder extends, and, specifically, each such hole receives a reduced diameter portion of the inking cylinder that is defined by one of its circumferential grooves. Each divider also has an arcuate edge portion which lies closely adjacent to the anilox cylinder.

An important feature of the machine of the Leanna et al patent is that its dividers are not normally in actual contact with either the inking cylinder or the anilox cylinder. Instead, their edges adjacent to those cylinders are slightly spaced from them, and the thickness of each divider is somewhat less than the width of the inking cylinder groove in which it is received.

To provide an air seal between each divider and the anilox and inking cylinders, there are passages in each divider that conduct pressure air to its edge portions adjacent to those cylinders, and air flow between the cylinder and the divider repels ink from the zone near the divider.

In the press of the Leanna et al patent, the fountain structure comprising the ink nozzles, the ink pan and the ink dams was mounted on the slidable support that carried the inking cylinder and the anilox cylinder, and it moved with those cylinders during press opening and press closing.

The problem heretofore encountered with machines of this type was that from time to time one or more of the dividers would come into contact with the inking cylinder, at one side of a groove therein, and a friction due to such contact would heat the rubber inking cylinder to the point of deteriorating it and would also warp the divider or dividers, which were made of plastic.

It was recognized that the basic cause of this problem was insufficient rigidity of the fountain structure, and particularly of the ink pan and its dividers, inasmuch as contact between a divider and the inking cylinder could only result from deformation or vibration of the divider, particularly such as could occur during press-opening and press-closing, when the carriage supporting the fountain structure and the inking and anilox cylinders moved towards and from the plate cylinder. When one surface of a divider contacted the inking cylinder, pressure air acted upon its opposite surface to maintain the divider engaged with the inking cylinder, even though the divider would have resumed its proper position in the absence of the pressure air flow.

It might be supposed that the problem could have been solved by reinforcing the ink pan to stiffen it. In fact, however, the ink pan extends across the full width of a press that normally accommodates a web having a width of 60 to 120 inches. Since the ink pan has to be as compact as possible in the direction lengthwise along the web, its long, narrow shape makes for an inherent lack of rigidity. Because it is unlikely that there will be perfect balance between forces applied at its opposite ends to actuate it for press opening and press closing motion, such actuation almost inevitably tends to twist and deform the ink pan. If the movable ink pan had been reinforced to be stiff enough to ensure against contact between the dividers and the inking cylinder, it would have been too bulky for the limited space usually available for it and too heavy to be moved easily during press opening and press closing.

The movable fountain structure entailed another inconvenience, although it was not recognized as such because nothing better was known. To accommodate movement of the fountain structure, flexible drain tubes ran from the ink pan to stationary ink reservoirs, one for each ink color. For each reservoir there was an ink pump by which ink was fed back to one or more ink nozzles, again by way of flexible tubes. In order to avoid the need for a separate ink pump for each ink nozzle, the tubes that connected a given pump with two or more nozzles that emitted the same color of ink were connected by means of tee fittings. There also had to be at least one flexible tube through which pressure air for the several dividers or ink dams was brought to the fountain structure from a stationarily mounted pump or other pressure air source. All of these flexible tubes and their connections tended to create a disorderly appearance and complicated the servicing of the machine.

SUMMARY OF THE INVENTION

The general object of the present invention is to provide a split-color flexographic press of the type disclosed in U.S. Pat. No. 4,165,688, having a fountain structure which is no less compact than the fountain structure disclosed in said patent, but which inherently prevents contact between the ink pan dividers and the inking cylinder and inherently makes for a more orderly and compact arrangement of pressure air and ink ducts.

Another object of the present invention is to provide a split-color flexographic press which is of the general type disclosed in U.S. Pat. No. 4,165,688 and is in all respects at least as versatile and compact as the press disclosed in that patent, but where there is an ink pan that is rigidly supported by opposite stationary frame members and can even serve as a rigid transverse member of the frame structure, and wherein dividers in the ink pan are prevented from contacting the inking cylinder by virtue of the rigidity of the ink pan.

Another and more specific object of this invention is to provide a split-color flexographic press which not only overcomes and avoids the above described problems with respect to contact between the ink pan dividers and the inking cylinder but which affords a simplified and less expensive inking fountain assembly, particularly with respect to the several ducts that carry inks and pressure air, eliminating the need for flexible tubes and/or movable duct connections that accommodated movement of the fountain structure.

It is also a specific object of the invention to provide a press of the character described that has certain advantages in the event of a web break and wrap-up.

In general, these objects of the invention are achieved in a rotary web printing press of the type having a plate cylinder that carries a printing plate, an impression cylinder for constraining a web to move in printing engagement with the plate cylinder, an inking cylinder on which inks are received and which has at least one circumferential groove to define discrete sections of its cylindrical surface, a transfer cylinder by which inks are transferred from said inking cylinder to said plate cylinder, fountain means for applying differently colored inks to the respective sections of the inking cylinder and for collecting and recirculating so much of said inks as are not transferred to the transfer cylinder, said fountain means comprising divider means for preventing mixing of different colored inks, having edge portions received in said groove and disposed adjacent to the periphery of the transfer cylinder, and a frame by which said cylinders and transfer means are carried.

Characterizing features of the press of this invention are the mounting of its transfer cylinder for rotation on an axis that is fixed in relation to its frame, and its fountain means being fixed in relation to its frame.

BRIEF DESCRIPTION OF DRAWINGS

In the accompanying drawings, which illustrate what is now regarded as a preferred embodiment of the invention.

DETAILED DESCRIPTION OF PREFERRED EMBODIMENT OF THE INVENTION

Figure 1:
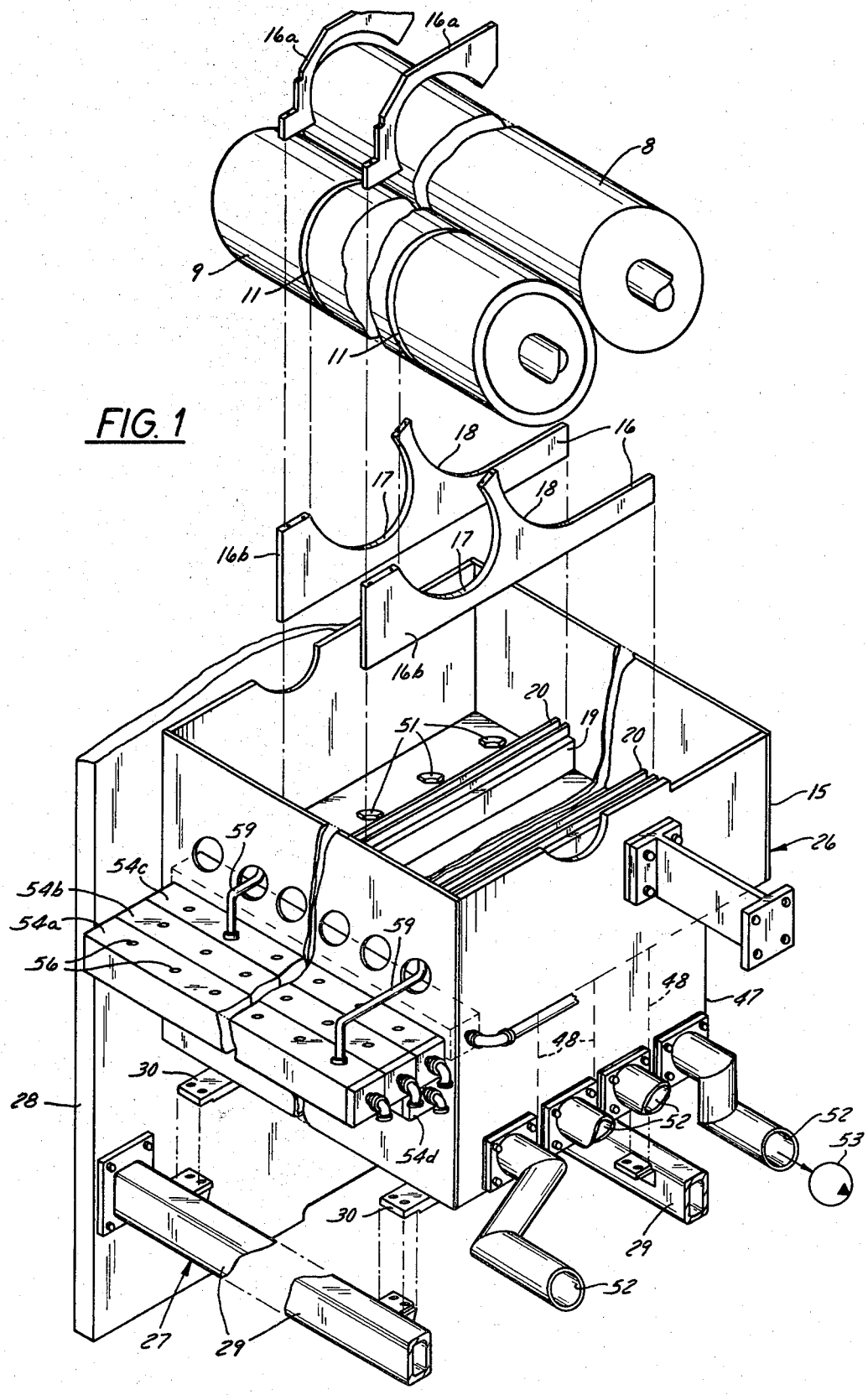
FIG. 1 is a fragmentary, partially disassembled perspective view of a split-color flexographic press of this invention.
Figure 2:
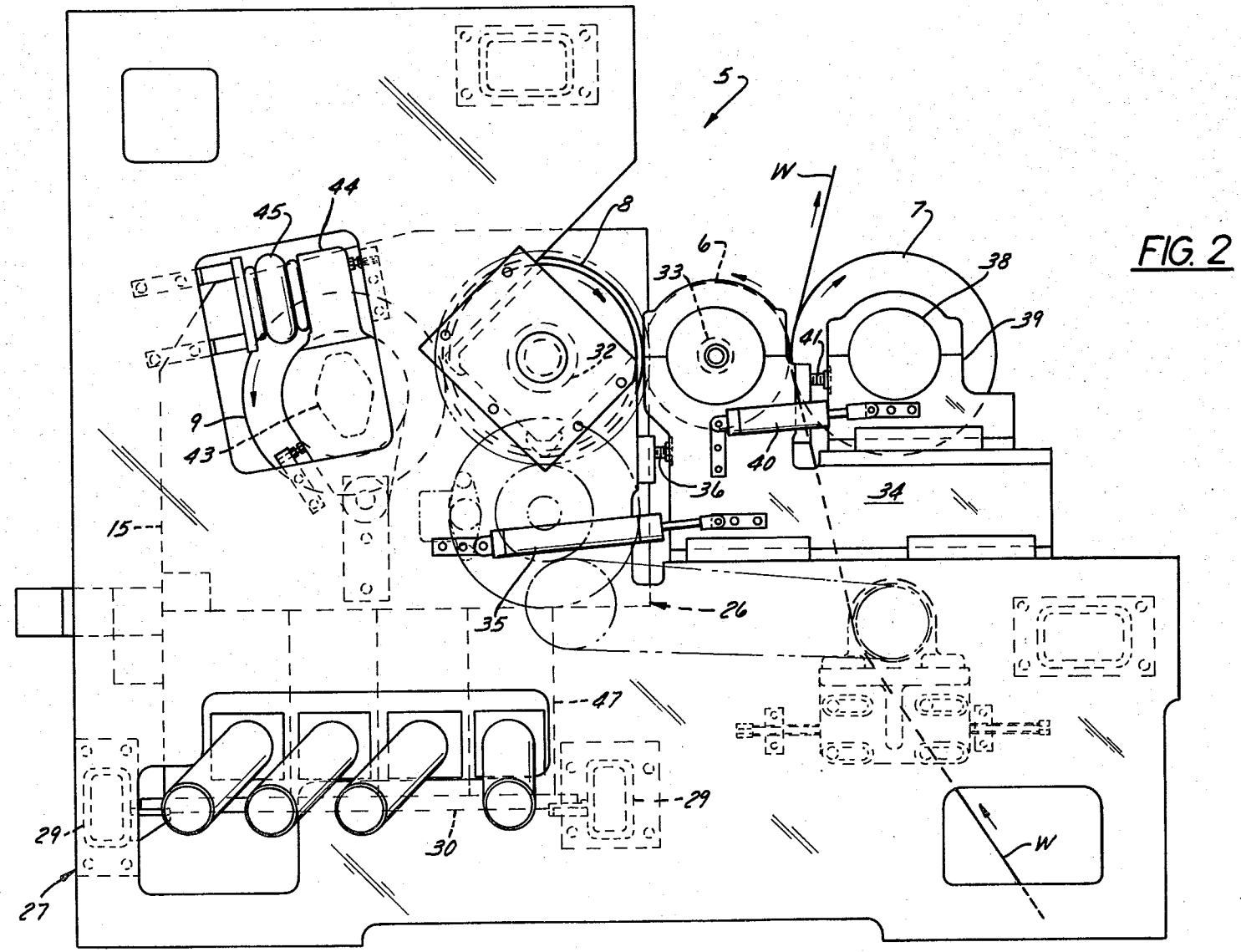
FIG. 2 is a view of the press in side elevation, showing the press in its operative condition.
Figure 3:
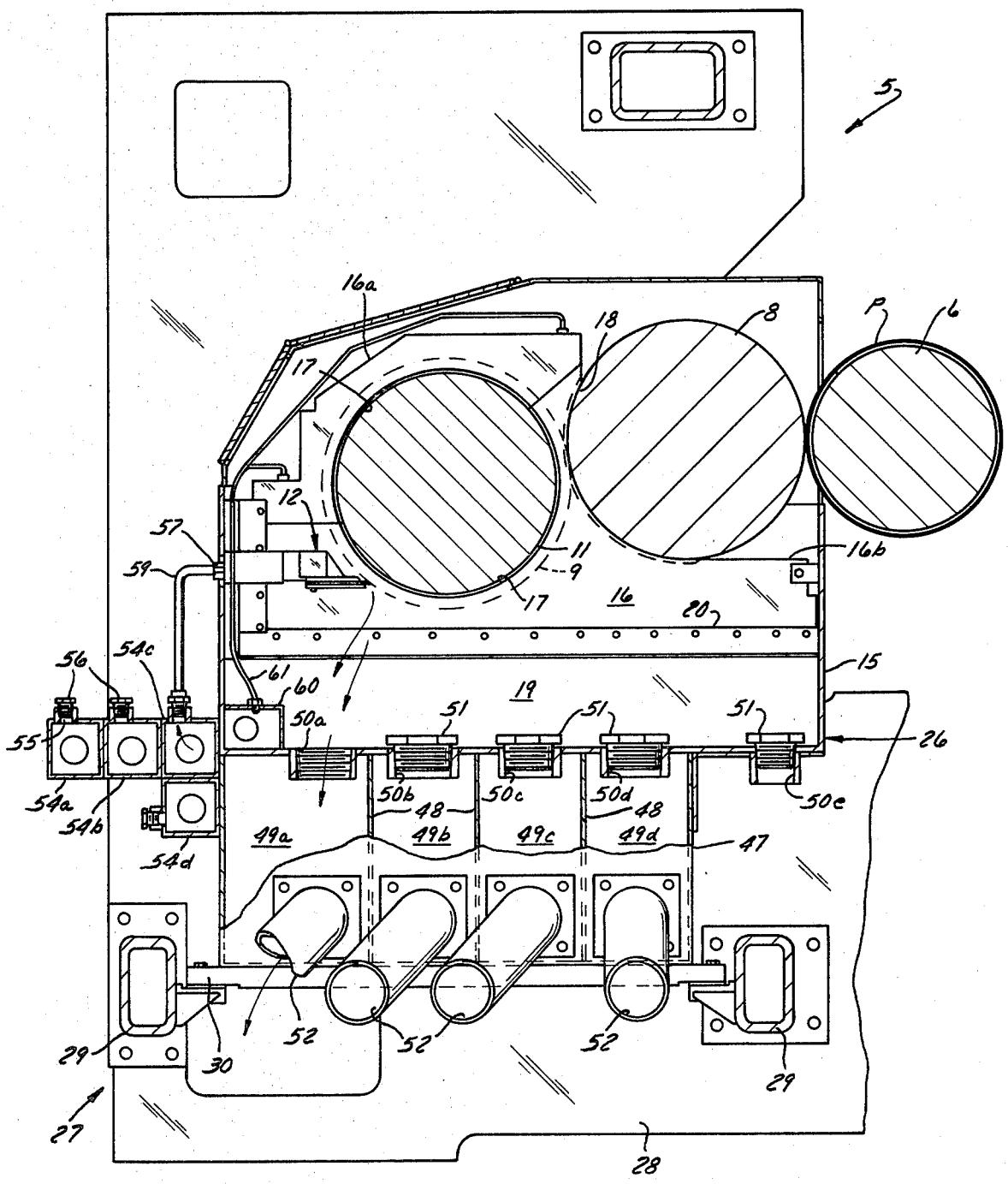
FIG. 3 is a view, partially in side elevation and partially in vertical section, illustrating the portion of the press that comprises its inking cylinder, anilox cylinder and plate cylinder, shown in their operative press-closed relationship.
Figure 4:
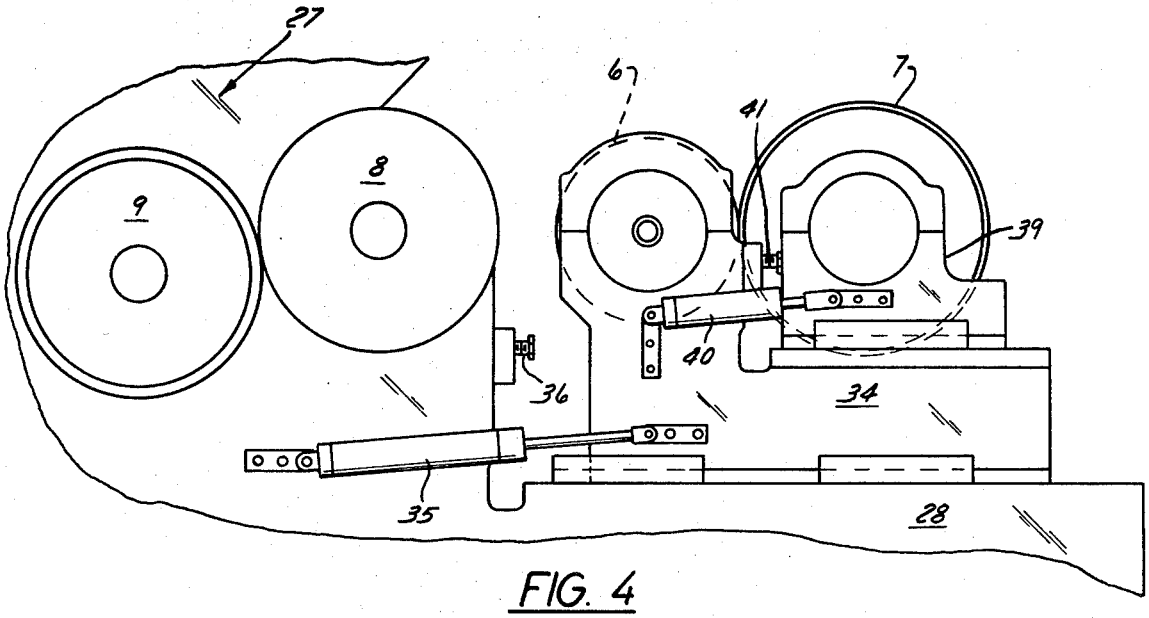
FIG. 4 is a more or less diagrammatic view in side elevation, showing the press in a partially open condition in which the anilox cylinder is spaced from the plate cylinder.
Figure 5:
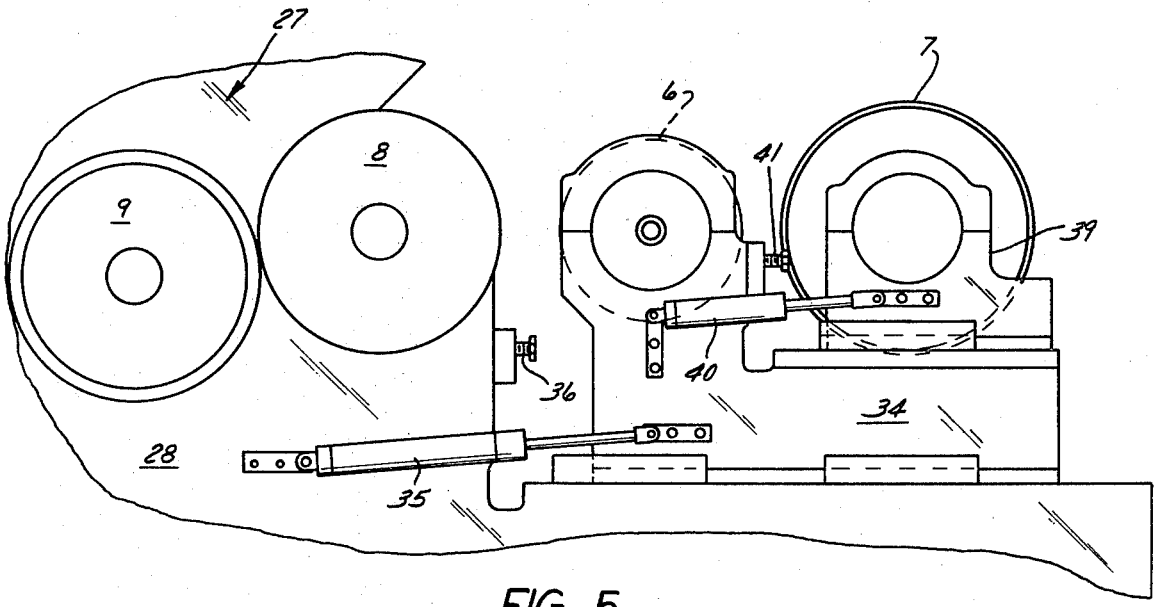
FIG. 5 is a view generally similar to FIG. 4 but showing the press in fully open condition.
Figure 6:
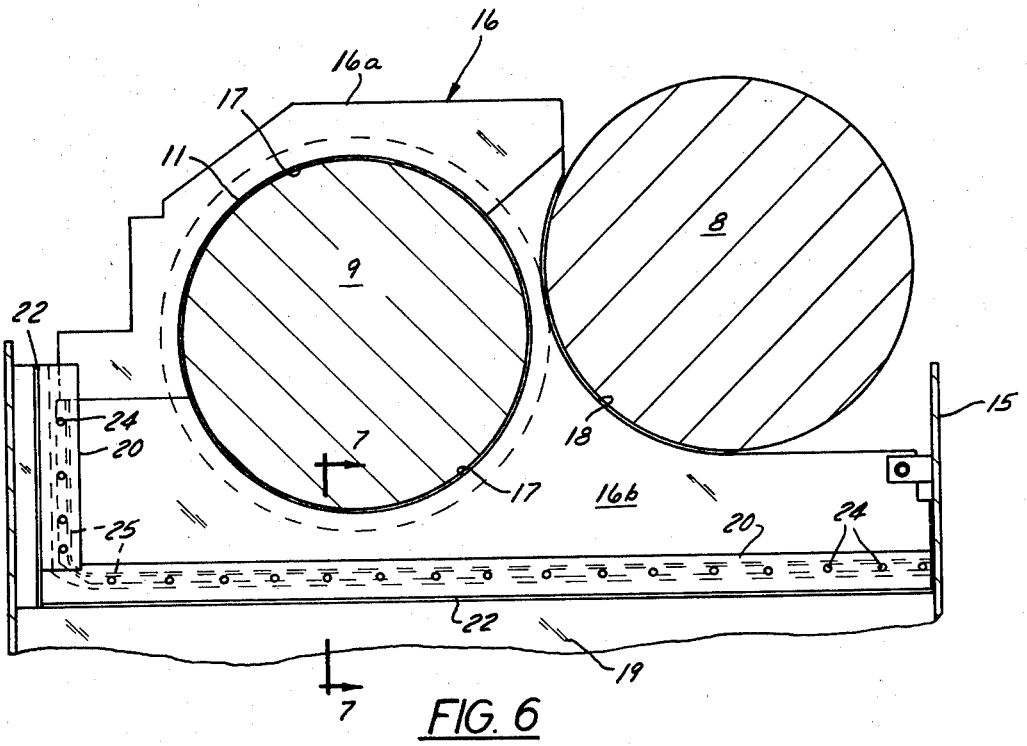
FIG. 6 is a fragmentary view in vertical section, on an enlarged scale, taken through the inking fountain structure and illustrating one of the ink dams in its relation to the inking cylinder and the anilox cylinder.
Figure 7:
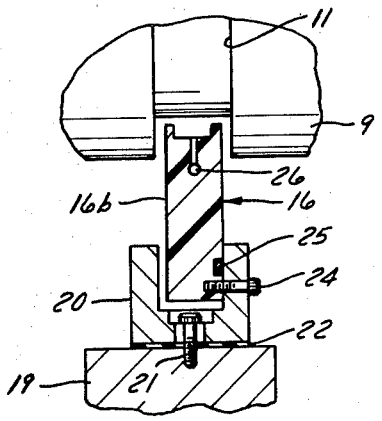
FIG. 7 is a fragmentary view in section taken on the plane of the line 7—7 in FIG. 6.

A flexographic press 5 that embodies the principles of this invention has a printing cylinder 6 which cooperates with an impression cylinder 7 for imprinting one side of a web W of paper or the like. As here illustrated, the printing cylinder 6 is a plate cylinder that has a flexible plate P removably attached to its cylindrical surface, and the design to be imprinted upon the web W is embossed or engraved on that plate. The web W is normally confined against the plate P by means of the impression cylinder 7, which rotates at the same peripheral speed as the plate cylinder 6 but in the opposite direction.

The ink that is imprinted onto the web W is applied to the printing cylinder 6 by an anilox or transfer cylinder 8 which rotates oppositely to the printing cylinder and contacts it at its side opposite the impression cylinder 7. The anilox cylinder 8, in turn, receives ink from an inking cylinder 9 which rotates oppositely to the anilox cylinder 8 and is in contact with the anilox cylinder at its side opposite the printing cylinder 6.

The imprint made upon the web W by means of a press of this invention is in the form of a number of bands that extend the full length of the web and are in side by side relation across it, and accordingly different colored inks are applied to the printing cylinder 6 at different zones along its length. To provide for such inking, the inking cylinder 9 has circumferential grooves 11 at regularly spaced intervals along its length, whereby the surface of the inking cylinder is divided into a number of sections, one for each of the several bands to be imprinted on the web. Although the same color ink may be applied to two or more adjacent sections, it is possible for every section to have a different ink color from its adjacent sections because ink is applied to each section from an ink nozzle 12 for that section that is located adjacent to the inking cylinder. For further details of the ink nozzle, reference may be made to the above identified Leanna et al patent.

To ensure adequate inking, ink flows out of each nozzle 12 somewhat faster than it is needed, and the excess ink runs off of the inking cylinder 9 and drops down into an ink pan 15 that is beneath the inking cylinder and the anilox cylinder. From the ink pan 15, as explained hereinafter, the ink drains to a reservoir from which it is fed back to the nozzle by means of a pump.

To keep the different colored inks separated from one another, the ink pan 15 is divided by ink dams or dividers 16 into a number of compartments, one for each section of the inking cylinder 9. Each ink dam 16 has edge portions 17 received in one of the grooves 11 in the inking cylinder, as well as another edge portion 18 adjacent to the periphery of the anilox cylinder 8. The edge portion 17 of each ink dam is defined by a hole in it that is substantially smaller in diameter than the inking surfaces of the inking cylinder but slightly larger in diameter than its reduced diameter portions defined by the circumferential grooves 11. To provide for assembly of the ink dams 16 with the inking cylinder 9, each ink dam 16 is made in two edgewise connected sections **16*a*, 16*b***, as more fully explained in the above-identified Leanna et al patent.

Each ink dam 16 comprises, in effect, an edgewise continuation of a thicker partitioning bulkhead 19 in the ink pan that projects a distance upwardly from the bottom wall of the ink pan and a distance rearwardly from its front wall. The several partitioning bulkheads 19 are in sealed relationship to the front, rear and bottom walls of the ink pan 15 and can provide stiffening reinforcement for it.

To secure each ink dam or divider 16 to the ink pan 15, the edge portions of the divider that are adjacent to the ink pan walls are received in U-section channels 20 that are secured to the relatively wide top and rear edges of the partitioning bulkhead 19 for the divider. As shown, each U-channel 20 has bolts 21 extending through its bight portion at intervals along its length that are received in threaded holes in the bulkhead 19 to hold the channel in place with a flat sealing gasket 22 clamped between it and the bulkhead. Each divider 16 must have some degree of flatwise side-to-side adjustablity, so that it can be centered in its groove 11 in the inking cylinder, and to that end the bolts 21 extend through transversely elongated slots in the bight portions of the channels 20. Each ink dam 16 is in turn secured to its channels 20 by bolts 24 at lengthwise spaced intervals along each channel, extending through one leg of the channel and received in threaded holes in the ink dam. A bead gasket 25, confined in a groove in the side face of the ink pan, provides a seal between the ink pan and its U-section channels 20.

Each ink dam 16 has edgewise extending air passages in it whereby pressure air is conducted to outlets 26 in its edge 17 and 18 that are respectively adjacent to the inking cylinder 9 and the anilox cylinder 8. Pressure air flowing between these divider edges 17 and 18 and the adjacent surfaces of the respective cylinders 9 and 8 provide air seals by which inks are prevented from flowing along either of those cylinders across the zone defined by the divider 16, so that inks of different colors cannot mix. For details of the air passages and air seals, reference can be made to the Leanna et al patent.

It will be apparent that the ink dams or dividers 16 are rigidly attached to the ink pan 15 and are confined against any kind of displacement so long as the ink pan is not twisted or deformed. In like manner the ink nozzles 12 are rigidly supported on the front wall of the ink pan, and their positions are thus fixed in relation to the ink pan 15 and the normal position of the inking cylinder 9.

In the press of this invention, the fountain structure 26, which comprises the ink pan 15, the ink dams or dividers 16 and the ink nozzles 12, is fixedly secured to stationary frame structure 27 and therefore is not normally subjected to distorting or deforming forces. As shown, the frame structure 27 comprises opposite upright side walls 28, a pair of parallel, transversely extending beams 29 secured in bridging relation to the side walls 28, and cross-members 30 which bridge the beams 29 at intervals along their length and to which the fountain structure 26 is secured. It will be apparent that the beams 29 and cross members 30 provide a very rigid supporting and reinforcing structure that is in effect integrated with the ink pan 15, and the rather substantial mass of this structure is of no consequence because the fountain structure 26 is stationary. Obviously the ink pan 15 could be made sturdy enough to have adequate rigidity without external support. By its fixed connections to stationary members of the frame 27 proper, the fountain structure 226 and any reinforcing structure associated with it can be integrated into the frame to make an actual contribution to sturdiness and rigidity of the frame as a whole.

In the press of the present invention, the anilox cylinder 8 rotates on a permanently fixed axis, in bearings 32 that are directly supported by the side walls 28 of the stationary press frame 27. For opening and closing the nip between the anilox cylinder 8 and the printing cylinder 6, the bearings 33 for the printing cylinder are carried by a lower slider or carriage 34 that is movable on the stationary press frame 27. The lower slider 34 is actuated by generally conventional means such as a double-acting hydraulic jack 35 connected between it and the stationary frame structure 27. Conventional adjustable abutment means 36 cooperate with the frame and the lower slider 34 to define for the latter a limit of its press-closing motion.

For opening and closing the nip between the printing cylinder 6 and the impression cylinder 7, the bearings 38 for the impression cylinder are carried by an upper carriage or slider 39 that is slidable upon the lower slider 34. The upper slider 39 is actuated by means of a double-acting hydraulic jack 40 or the like, connected between it and the lower slider 34, and an adjustable abutment 41 cooperates with the two sliders 33, 39 to define a limit of press-closing motion of the upper slider 39.

With an impression cylinder that rotated on a fixed axis, as has heretofore been conventional, the nip between it and the printing cylinder could be opened only by movement of the ink fountain structure and of the inking and anilox cylinders as well as the plate cylinder, because the plate cylinder could not move to its press-open position without making room for it. This meant that in the event of a web break and wrap-up, emergency press opening required actuation of two carriages or sliders and movement of a substantial mass. With the arrangement of the present invention, only the upper slider 39 and the impression cylinder 7 need be moved to effect such emergency press openings, and therefore the impression cylinder 7 and the printing cylinder 6 can be separated more quickly in the event of a wrap-up, reducing the chances for bending the shaft of one of those cylinders.

The bearings 43 for the inking cylinder 9 are carried at the upper ends of swingable arms 44 that have their lower ends pivoted to the stationary frame structure 27. The pivot axis of those arms 44 is so located that gravity tends to swing the inking cylinder 9 away from the anilox cylinder 8, but the inking cylinder is normally maintained in contact with the anilox cylinder by means of air-operated bellows 45 that act upon the upper ends of the arms 44. When the press is normally shut down, the lower slider or carriage 34 is actuated to carry the plate cylinder 6 out of engagement with the anilox cylinder 8, but for a short period of time, under conventional control of a time delay unit (not shown), the impression cylinder 7 remains in its press-closed position, so that the residual ink on the plate cylinder 6 is applied to the web. Then, after a few revolutions of the plate cylinder 6, the upper slider 39 is actuated to move the impression cylinder 7 away from the plate cylinder 6. Meanwhile, the inking cylinder 9 and the anilox cylinder 8 remain engaged with one another and continue to be rotated a slow speed to prevent ink from drying on the anilox cylinder. By relieving air pressure in the bellows 45, the inking cylinder 9 can be permitted to move a small distance away from the anilox cylinder 8, as for cleaning of those cylinders.

The stationary mounting of the fountain structure 26 makes possible a simple arrangement of ducts for inks and pressure air and facilitates changing the ink color used on any section of the inking cylinder 9. As here shown, the fountain structure 26 comprises a compartmented ink tank 47 beneath the ink pan 15, extending for substantially its full length, and having upright partitions 48 which extend parallel to the axes of the cylinders 6–9 and divide its interior into a number of ink reservoirs **49*a*–49*d*, one for each ink color. In each of the ink pan compartments that are defined by the dividers 16 the bottom wall of the ink pan has outlets 50*a*–50*d* that open downwardly into the respective ink reservoirs 49*a*–49*d*, plus an additional cutlet 50*e* that opens to a space below the rear of the ink pan, to be used for clean-out drainage. Each of the outlets 50*a*–50*e* can be closed by a readily removable plug 51, and normally only one of the outlets will be open at any time, namely that one that leads to the ink reservoir 49*a*–49*d* alloted to ink of the color being used in the compartment. The outlets 50–50*d*, which comprise inlets to the reservoirs 49*a*–49*d*, are thus arranged in such a manner that each reservoir has an inlet from each compartment of the ink pan 15** and serves as a return manifold for ink of one color.

Each of the reservoirs **49*a*–49*d* has an outlet 52 at one end thereof that is communicated with an ink pump 53. There is of course one ink pump 53 for each of the reservoirs 49*a*–49*d* and an ink filter (not shown) for each ink pump. On the front of the fountain structure there is a group of elongated ink feed duct manifolds 54*a*–54*d*, one for each ink color, each extending across all of the compartments in the ink pan 15 and connected at one end with the output side of an ink pump 53. Each of the feed manifolds 54*a*–54*d* has accessibly located outlets with nipple fittings 55, spaced at such intervals along its length that there is at least one fitting 55 in line with each compartment in the ink pan 15. Each of the outlet fittings 55 can be closed by a readily removable plug 56. Each of the ink nozzles 12 has an ink inlet fitting 57 which can be similar to the nipple fittings 55. The ink nozzle 12 in each ink pan compartment can be connected with any one of the ink feed manifolds 54*a*–54*d* by removing the plug 56 in the adjacent nipple fitting 55 of that manifold and connecting to that fitting and to the nozzle fitting 57 a short length of hose or tubing 59** having mating readily disconnectable fittings on its opposite ends.

When ink color is to be changed on a section of the inking cylinder, the change is effected by merely reconnecting the ink nozzle 12 for that section with the appropriate ink feed manifold **54*a*–54*d* and making an appropriate change in one of the drain plugs 51. Such a change would require cleanup of only the ink compartment and its nozzle 12, the appropriate sections of the cylinders 6, 8 and 9, and possibly the ink nozzle connection tube 59**, without need for cleaning out an ink pump or ink ducting.

A pressure air manifold 60 that extends along the ink pan, across the several compartments in it, has an outlet at each compartment and an inlet at one of its ends that is connected with a pressure air source. Each of its outlets is connected by means of a short duct 61 with a pressure inlet in one of the ink dams 16.

From the foregong description taken with the accompanying drawings, it will be readily apparent that this invention provides a split-color web press which is sturdy, compact and inexpensive and wherein the ink pan and its dividers or ink dams are stationary fixed to the machine frame to avoid imposition of forces upon the ink dams that could deform them into rubbing engagement with the inking cylinder.

I claim:

1. A rotary press comprising a printing cylinder by which impressions in each of a predetermined number of differently colored inks can be simultaneously applied to different portions of a web across the width thereof, an impression cylinder by which a lengthwise moving web is confined in printing contact with the printing cylinder, an inking cylinder from which inks are transferred to the printing cylinder and which has a plurality of sections along its length, an ink nozzle for each section from which ink can be applied to the section, an ink pan beneath the inking cylinder to receive excessive inks issuing from the ink nozzles, a plurality of ink dividers in said ink pan whereby the same is divided into compartments, one for each of said sections, and whereby ink issuing from each nozzle is prevented from mixing with inks issuing from adjacent nozzles, and a stationary frame that supports said cylinder, said nozzles and said ink pan, said press being characterized by:

A. the printing cylinder and the impression cylinder being rotatably supported on carriages which are movable on said frame to carry those cylinders for press opening and press closing motion towards and from one another and the inking cylinder;

B. the ink pan, the ink nozzles and the ink dividers being in fixed relation to said frame;

C. a plurality of elongated laterally adjacent reservoirs beneath said ink pan, one for each of said inks, each extending across all of said compartments in the ink pan;

D. said ink pan having a plurality of readily closeable outlets in the bottom of each of its compartments, each opening downwardly into one of said reservoirs for drainage of ink from the compartment into the appropriate reservoir;

E. a plurality of elongated, laterally adjacent ink feed manifolds, one for each of said reservoirs, each extending across all of said compartments in the ink pan and each having a plurality of lengthwise spaced readily closeable outlets, one near each of said ink nozzles, each outlet comprising a fitting that accommodates a readily removable connection between the ink feed manifold and an ink nozzle; and F. a plurality of ink pumps, each connected to draw ink from one of said reservoirs and deliver it to the ink feed manifold for that reservoir.

2. The rotary web press of claim 1 wherein said inking cylinder rotates on an axis which is substantially fixed in relation to said frame, further characterized by:

G. the carriage by which said impression cylinder is carried being movably carried on the carriage by which said printing cylinder is carried.

3. A rotary press comprising a printing cylinder by which impressions in each of a predetermined number of differently colored inks can be simultaneously applied to different portions of a web across the width thereof, an impression cylinder by which a lengthwise moving web is confined in printing contact with the printing cylinder, an inking cylinder from which inks are transferred to the printing cylinder and which has a plurality of sections along its length, an ink nozzle for each section from which ink can be applied to the section, an ink pan beneath the inking cylinder to receive excessive inks issuing from the ink nozzles, a plurality of ink dividers in said ink pan whereby the same is divided into compartments, one for each of said sections, and whereby ink issuing from each nozzle is prevented from mixing with inks issuing from adjacent nozzles, and a stationary frame that supports said cylinders, said nozzles and said ink pan, said press being characterized by:

A. the printing cylinder and the impression cylinder being rotatably supported on carriages which are movable on said frame to carry those cylinders for press opening and press closing motion towards and from one another and the inking cylinder;

B. the ink pan, the ink nozzles and the ink dividers being in fixed relation to said frame;

C. an ink pump for each of said differently colored inks; and

D. means for effecting unmixed circulation of inks from said ink pumps to respective ink nozzles and from said compartments back to the ink pumps, characterized by (1) a reservoir for each ink pump, (2) a plurality of readily closeable outlets in a bottom wall of each compartment, each draining to one of said reservoirs, and (3) a plurality of elongated feed manifolds, one connected with each ink pump, each having a plurality of readily closeable nozzle connection outlets that are spaced along its length and so located that each ink nozzle is near one of said nozzle connection outlets, each nozzle connection outlet having means providing for readily detachable connection thereto of a duct that communicates it with an ink nozzle.

* * * * *